US008325117B2

(12) United States Patent
Le Roy et al.

(10) Patent No.: US 8,325,117 B2
(45) Date of Patent: Dec. 4, 2012

(54) IMAGE DISPLAY SCREEN

(75) Inventors: Philippe Le Roy, Betton (FR); Christophe Prat, Nantes (FR); Fabien Ammardji, Saint Malo (FR)

(73) Assignee: Thomson Licensing, Boulogne-Billancourt (FR)

( * ) Notice: Subject to any disclaimer, the term of this patent is extended or adjusted under 35 U.S.C. 154(b) by 1221 days.

(21) Appl. No.: 10/583,823

(22) PCT Filed: Dec. 1, 2004

(86) PCT No.: PCT/FR2004/003088

§ 371 (c)(1),
(2), (4) Date: Aug. 24, 2007

(87) PCT Pub. No.: WO2005/071648

PCT Pub. Date: Aug. 4, 2005

(65) Prior Publication Data

US 2008/0093994 A1 Apr. 24, 2008

(30) Foreign Application Priority Data

Dec. 23, 2003 (FR) ..... 03 15296

(51) Int. Cl.
*G09G 3/32* (2006.01)

(52) U.S. Cl. ..... 345/82; 345/76; 345/92

(58) Field of Classification Search ..... 345/92, 345/95, 214, 215, 210, 76–83
See application file for complete search history.

(56) References Cited

U.S. PATENT DOCUMENTS

| | | | | |
|---|---|---|---|---|
| 5,012,314 | A * | 4/1991 | Tobita et al. | 250/205 |
| 5,444,457 | A * | 8/1995 | Hotto | 345/94 |
| 6,069,620 | A * | 5/2000 | Nakamura et al. | 345/214 |
| 6,677,937 | B1 * | 1/2004 | Takahashi et al. | 345/212 |
| 7,151,513 | B2 * | 12/2006 | Li et al. | 345/76 |
| 2003/0052614 | A1 * | 3/2003 | Howard | 315/169.1 |
| 2005/0007352 | A1 * | 1/2005 | Nathan et al. | 345/204 |
| 2007/0080905 | A1 * | 4/2007 | Takahara | 345/76 |

FOREIGN PATENT DOCUMENTS

| | | |
|---|---|---|
| EP | 1094438 | 4/2001 |
| EP | 1197943 | 4/2002 |
| JP | 2002091376 | 3/2002 |
| JP | 2003216100 | 7/2003 |
| KR | 20000026916 | 5/2000 |

OTHER PUBLICATIONS

Search Report Dated Jun. 24, 2005.

* cited by examiner

*Primary Examiner* — Amare Mengistu
*Assistant Examiner* — Premal Patel
(74) *Attorney, Agent, or Firm* — Robert D. Shedd; Patricia A. Verlangieri

(57) ABSTRACT

Image display screen suitable for displaying image frames, at a given screen scanning frequency, comprising, light emitters, circuits for addressing the emitters each comprising, a current modulator able to supply the said emitter with current during the screen display mode, a charge capacitance able to store at each image frame a potential applied to the gate electrode of the current modulator, the potential being representative of a voltage for addressing an image datum during a screen display mode. The screen comprises a control system able to apply a bias voltage to the gate electrode of the current modulator and to the said charge capacitance, during a screen standby mode of a duration greater than the duration of an image frame, the said bias voltage having a bias inverse to the bias of the potential applied to the said charge capacitance during the screen display mode.

19 Claims, 3 Drawing Sheets

IMAGE DISPLAY SCREEN

This application claims the benefit, under 35 U.S.C. §365 of International Application PCT/FR04/03088, filed Dec. 1, 2004, which was published in accordance with PCT Article 21(2) on Aug. 4, 2005 in English and which claims the benefit of French patent application No. 0315296, filed Dec. 23, 2003.

The invention relates to an image display screen.

The invention pertains to an image display screen of the type suitable for displaying image frames, at a frequency of scanning of the lines of the screen comprising:

- light emitters distributed as rows of emitters and columns of emitters to form an array of emitters, the emitters of the array being able to be supplied with a current during a screen display mode;
- an emitter addressing circuit, associated with each emitter of the array, the said circuit comprising:
- a current modulator able to supply current to the said emitter, during the said display mode, the said modulator comprising a gate electrode and two current flow electrodes,
- a charge capacitance able to store, at each image frame, an addressing voltage representative of an image datum during the said display mode, the said voltage being applied to the gate electrode of the current modulator;
- a control system able to apply a bias voltage to the gate electrode of the current modulator, during a screen standby mode, the said bias voltage having a bias inverse to the bias of the addressing voltage applied to the said charge capacitance during the screen display mode.

In particular, the invention pertains to a display screen based on organic electroluminescent materials, with active matrix fabricated from amorphous silicon.

Thin-film transistors made of hydrogenated amorphous silicon have advantages as compared with transistors made of polycrystalline silicon for the design of such screens since they are easier to fabricate and they exhibit a uniformity of luminance over samples of relatively large size.

However, the triggering threshold voltage of amorphous silicon transistors drifts over time during the application of a voltage between their gate and their source. The drifting of the triggering threshold voltage of a transistor over time produces a modification of the current supplying the light emitting organic component to which it is linked and forming a pixel of the screen. Now, the luminance of these components is directly proportional to the current passing through them.

Consequently, the drifting of the triggering threshold voltage of transistors causes marking phenomena that appear on the screen after a certain period of display.

In particular, the documents EP-1 220 191 and U.S. 2003/0094616 disclose a screen comprising a means of supervision able to maintain a constant voltage between the gate and the source of the amorphous silicon transistors of the active matrix of the screen so as to compensate for the drifting of their triggering threshold voltage.

In particular, the document U.S.-2003/0052614, discloses a display screen comprising a control system able to apply a bias voltage, having a polarity inverse to the polarity of the addressing voltage, to the gate of the current modulators of the emitters.

However, the luminance of this screen is low since the periods of application of this inverse bias encroach on the duration available for display in each frame.

The aim of the invention is to propose an alternative screen that exhibits sufficient luminance and small variations thereof over time.

To this end, a subject of the invention is a display screen of the aforesaid type, characterized in that the duration of application of the bias voltage having a bias inverse to the bias of the addressing voltage is greater than the duration of an image frame.

According to particular embodiments, the display screen comprises one or more of the following characteristics:

- the control system comprises addressing control means able to apply on the one hand the said addressing voltage to the gate electrode of the current modulator during the screen display mode and, on the other hand, the said bias voltage during the screen standby mode.
- the control system comprises means of control of scanning of the lines of the screen that are adapted for decreasing the frequency of scanning of the lines of the screen during the screen standby mode to a frequency below the frequency of scanning of the lines during the display mode.
- the frequency of scanning of the screen lies between 5 and 20 kilohertz during the screen standby mode;
- the screen standby mode has a constant and predefined duration.
- the duration of the screen standby mode lies between 1 and 2 hours.
- the value of the bias voltage is constant and predefined.
- the value of the bias voltage lies between −8 volts and −25 volts.
- the control system comprises means of calculation of the sum of the said voltages applied, at each image frame, to the gate electrode of each current modulator during the screen display mode, the said means of calculation being able to determine characteristics of a bias voltage suitable for being applied to each current modulator, as a function of the said sum of the said voltages applied to this modulator, and the control system is able to apply, to each modulator, the said suitable bias voltage determined by the means of calculation, during the screen standby mode.
- the characteristics of the bias voltage that are determined by the means of calculation comprise the duration of application of the bias voltage.
- the characteristics of the bias voltage that are determined by the means of calculation comprise the value of the said bias voltage.
- it comprises means for supplying power to the emitters and the control system comprises means for cutting the supply to the emitters during the screen standby mode.

The invention will be better understood on reading the description which follows, given merely by way of example and while referring to the drawings, in which.

Figure 1:
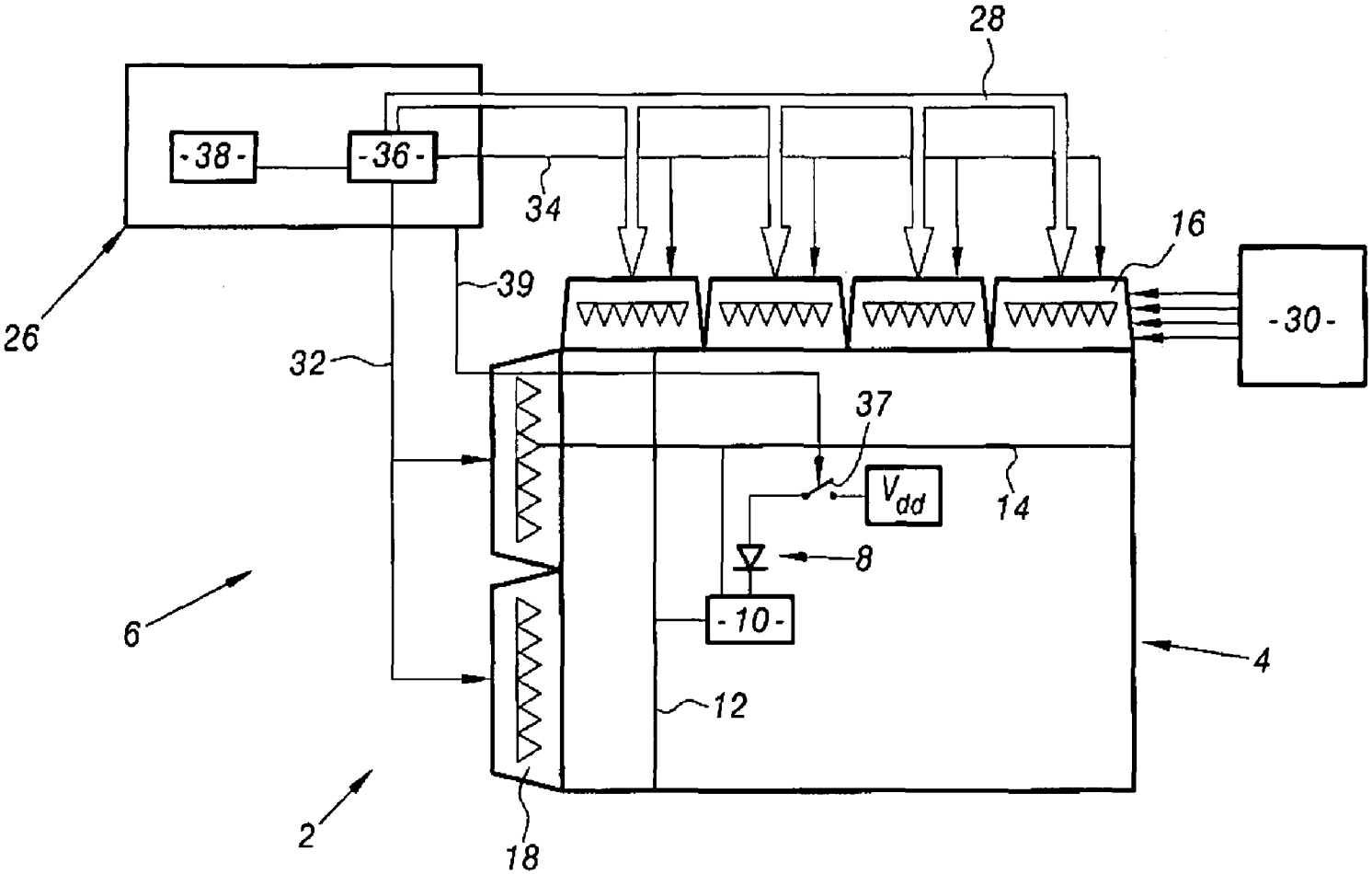
FIG. 1 is a diagrammatic view of a display screen according to a first embodiment of the invention.

FIG. 1 diagrammatically represents a display screen 2 based on electroluminescence organic materials, with active matrix, according to the invention.

This screen 2 comprises an active matrix 4 as well as means of control 6 of the latter.

The active matrix 4 comprises light emitters 8, addressing circuits 10, column addressing electrodes 12, row selection electrodes 14, column drive units 16 and row drive units 18.

The light emitters 8 of the display screen are organic electroluminescence diodes. They are able to be supplied by a power generator $V_{dd}$ connected to their anode. They are each linked to an addressing circuit. The addressing circuits 10 and the emitters 8 are distributed as rows and columns and form an array.

The addressing circuits 10, aligned along rows, are connected to the row selection electrodes 14. The addressing circuits 10, aligned along columns, are connected to the column addressing electrodes 12.

The selection electrodes 14 are linked to the row drive units 18. The addressing electrodes 12 are linked to the column drive units 16.

Figure 2:
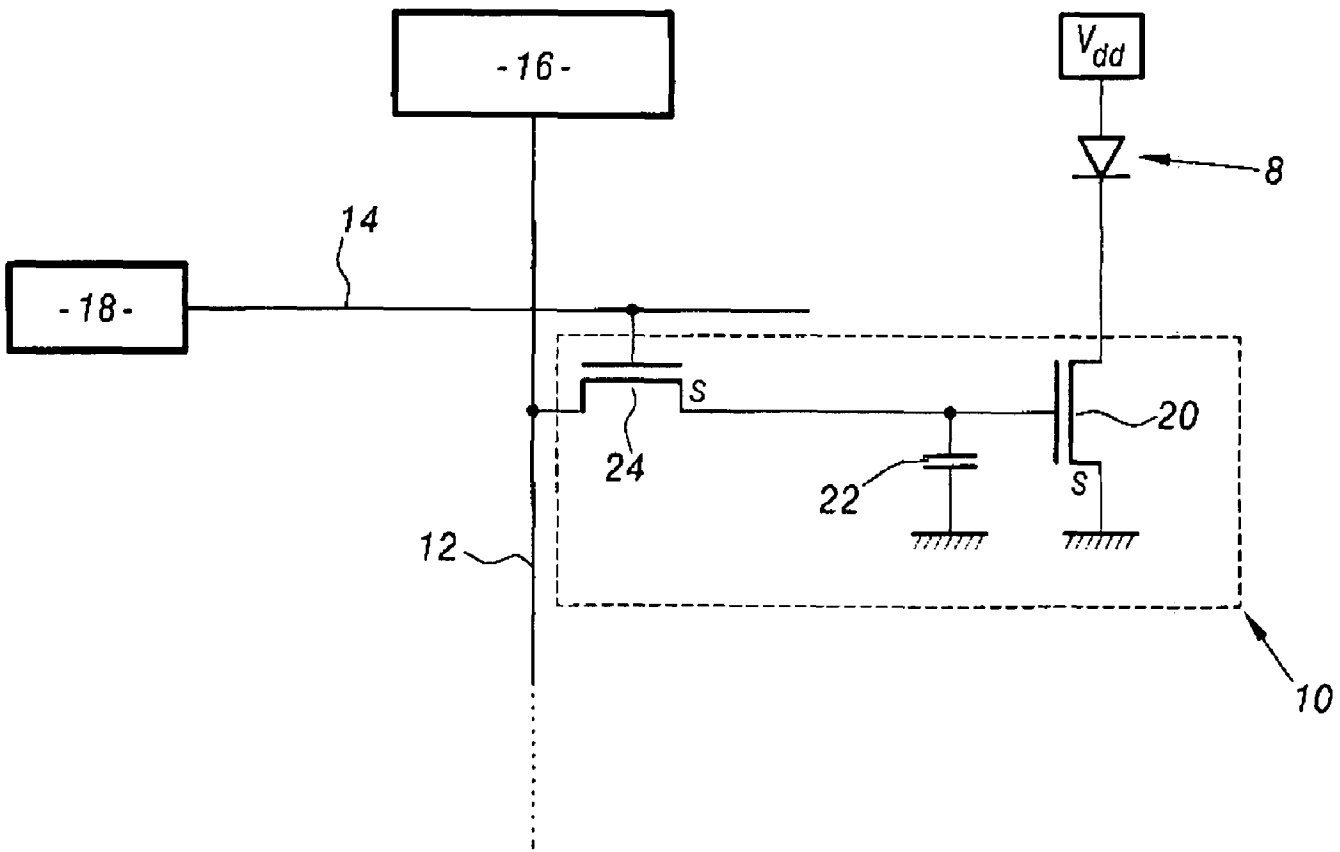
FIG. 2 is a diagrammatic view of an exemplary addressing circuit of an emitter according to the invention.

An exemplary addressing circuit 10 according to the invention is represented in FIG. 2. It comprises a current modulator 20, a charge capacitance 22 and a selection breaker 24.

The current modulator 20 and the selection breaker 24 are thin-film transistors (TFT) of n type. Such components comprise three electrodes: a drain electrode, a source electrode and a gate electrode. A current is able to pass between the drain electrode and the source electrode of the transistor when a voltage greater than its trigger threshold voltage $V_{th}$ is applied between its gate electrode and its source electrode. Alternatively, transistors of p type could also be used for the embodying of the invention.

The drain of the modulator 20 is connected to the cathode of the emitter 8. The source of the modulator 20 is hooked up to an earth electrode. The gate of the modulator 20 is wired to a terminal of the charge capacitance 22 whose other terminal is linked to an earth electrode. The gate of the modulator 20 is also hooked up to the source of the selection breaker 24. The drain of the breaker 24 is connected to the column addressing electrode 12. The gate of the breaker 24 is hooked up to the row selection electrode 14.

The means 6 of control of the addressing of the emitters are represented in FIG. 1. They comprise a control system 26, a databus 28, a grey scale voltage reference system 30, a line 32 for transmitting a selection signal and a line 34 for transmitting a synchronization signal.

The control system 26 is able to control the successive addressing of each pixel of the screen for the construction of image frames following one another at a given scanning frequency, the so-called display frequency. It comprises addressing control means 36 and scanning control means 38.

The addressing control means 36 are connected to the column drive units 16 by the databus 28 so as to address the column drive units 16 with addressing instructions. The addressing instructions comprise numerical data representative of image data during a mode of operation of the screen called the screen display mode and comprise a datum concerning the bias during another mode of operation of the screen called the screen standby mode.

The column drive units 16 comprise means of reception of addressing instructions by the bus 28 and are suitable for converting them into analogue data with the aid of the reference system 32 and to apply a voltage representative of this datum to a column addressing electrode 12.

During the screen standby mode, the column drive units 16 are adapted to apply bias voltages having a polarity of opposite sign to the polarity of the addressing voltages, representative of image data, applied during the display mode, to the electrodes 12. The application of an addressing voltage representative of an image datum to the gate of an amorphous silicon modulation transistor brings about a drifting of the triggering threshold voltages. The application of a bias voltage brings about a drifting of its triggering threshold voltage in a reverse direction. More precisely, the triggering threshold voltage of the transistors increases during the display mode and decreases during the screen standby mode.

The value of the bias voltage applied by the drive units is constant and predefined. It is for example between −8 volts and −25 volts.

The screen standby mode has a constant and predefined duration greater than an image frame. Preferably, the duration of the screen standby mode lies between 1 and 2 hours.

The screen standby mode is established automatically after the user has pressed a button for end of image display at the scanning frequency.

Moreover, the control system 26 comprises means for cutting the supply to the emitters during the screen standby mode. These means comprise for example a breaker 37 and a line 39 for controlling the opening and the closing of this breaker.

Likewise, the addressing control means 36 are linked to the drive units 18 via the line 32, so as to transmit a selection signal to them. On receipt of this selection signal, the row drive units 18 are able to apply a selection voltage successively to each selection electrode 14 to which the drive unit 18 is linked so as to select an addressing circuit 10 for an emitter of a column already addressed by a column addressing electrode 12. In the course of an image frame, the drive units 16 and 18 are able to address all the emitters of the screen successively.

The addressing control means 36 are linked to the column drive units 16 by the line 34 so as to transmit a synchronization signal to the column drive units 16 via the line 34. This signal makes it possible to synchronize the addressing of a column of emitters with the selecting of a row of emitters.

The scanning control means 38 are connected to the addressing control means. They comprise for example a clock which defines the period of the selection and synchronization and control pulses as well as the rate of scanning of the screen.

The scanning control means 38 are able to decrease the frequency of scanning of the lines of the screen during the screen standby mode to a frequency below the frequency of scanning of the lines during the displaying of the images. Preferably, this frequency is then between 5 and 20 kilohertz.

When the screen is in display mode, the column drive unit 16 applies an addressing voltage representative of an image datum to the addressing electrode 12. Simultaneously, the row drive unit 18 applies a selection voltage to the selection electrode 14. The breaker 24 of the addressing circuit 10, at the crossover of the addressing electrode 12 and of the selection electrode 14, is re-enabled. The addressing voltage is applied to the gate of the modulator 20 and to a terminal of the charge capacitance 22. The application of an addressing voltage to the gate of the modulator 20 generates the appearance of a drain current passing through the modulator 20 from its drain to its source. This current supplies the emitter 8. Thereafter, the potential stored at the gate of the modulator 20 by the charge capacitance 22 makes it possible to keep the current passing through the emitter 8 up to the end of the image frame.

When the screen is in standby mode, the column drive unit 16 applies a bias voltage to the addressing electrodes 12. When the row drive unit 18 applies a selection voltage on the electrode 14, the bias voltage applied to the electrode 12 is transmitted to the gate of the modulator 20 and to a terminal of the charge capacitance 22. The charge capacitance 22 stores charges representative of the bias voltage at the electrode of the modulator 20. The triggering threshold voltage of the modulator 20, that had drifted when the screen was previously in image display mode, then drifts in the opposite direction during the screen standby mode: advantageously this thus culminates in a compensation of the drifts that makes it possible, over the long term, to keep the triggering threshold of all the modulators of the screen at an almost constant level.

Figure 3:
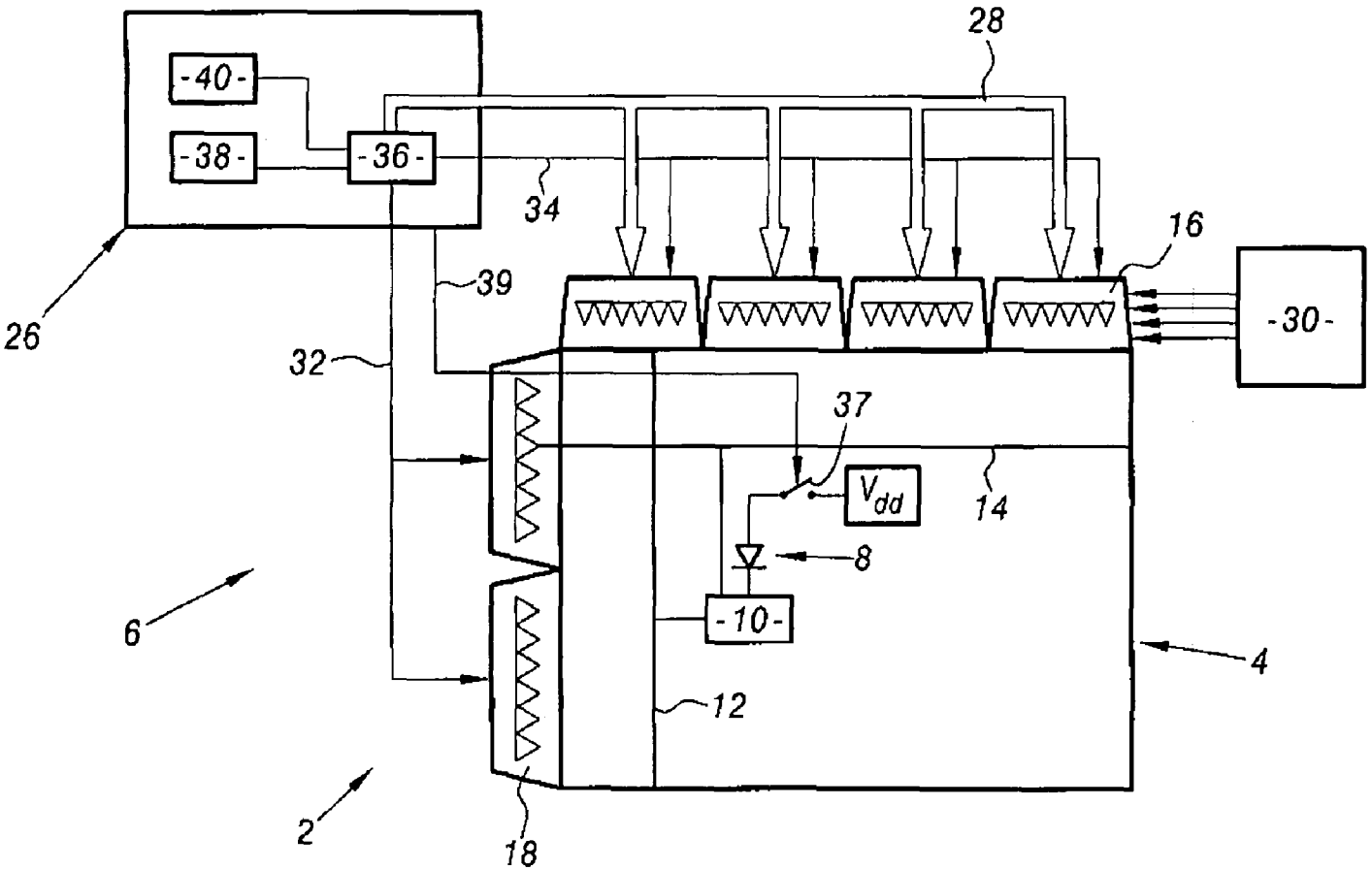
FIG. 3 is a diagrammatic view of a display screen according to a second embodiment of the invention.

FIG. 3 represents a second embodiment of the invention.

According to this embodiment, the control system 26 also comprises means of calculation 40 suitable for evaluating the drift of the triggering threshold voltages of each modulator 24 of the screen.

These means of calculation 40 comprise means of reception and means of summation.

The means of reception are able to collect the value of each addressing voltage representative of an image datum applied to the gate of each modulator 20 of the screen addressing circuits for the duration of the display mode.

The means of summation are suitable for calculating the value of the drift of a modulator by addition on the one hand of the values of the addressing voltages applied to a modulator 20 at each image frame and on the other hand of the total duration of the mode of display of the screen.

These means of calculation 40 are adapted for searching through a database for the value and the duration of the bias voltage to be applied to each modulator to compensate for the drift of its triggering threshold so that it recovers its initial value.

The means of calculation 40 are able to dispatch to the addressing control means 36 the information concerning the value and the duration of bias voltage to be applied to each modulator. The addressing control means 36 are able to generate an addressing instruction as well as a selection and synchronization signal suitable for each modulator. The column drive units 16 are able to apply to each modulator 20 of the screen a bias voltage with a value determined by the means of calculation 40. The row drive units 16 are able to apply a selection voltage to each breaker so as to discharge the charge capacitance 22 after a duration determined by the means of calculation 40.

Advantageously, the screen marking phenomenon is softened by the use of the invention.

Since the power supply to the emitters is cut during the screen standby mode, the display screen according to the invention consumes little electrical energy.

The invention claimed is:

1. Image display screen suitable for displaying image frames, comprising:

light emitters distributed as rows of emitters and columns of emitters to form an array of emitters, the emitters of the array being able to be supplied with a current during a screen display mode;

an emitter addressing circuit, associated with each emitter of the array, the said circuit comprising:

a current modulator able to supply current to said emitter, during said display mode, said modulator comprising a gate electrode and two current flow electrodes, a charge capacitance able to store, at each image frame, an addressing voltage representative of an image datum during said display mode, said voltage being applied to the gate electrode of the current modulator;

a control system able to apply a bias voltage to the gate electrode of the current modulator, during a screen standby mode, said bias voltage having a bias inverse to the bias of the addressing voltage applied to said charge capacitance during the screen display mode, wherein the control system comprises addressing control means able to apply on the one hand said addressing voltage to the gate electrode of the current modulator during the screen display mode and, on the other hand said bias voltage during the screen standby mode, the duration of application of said bias voltage having a bias inverse to the bias of the addressing voltage is greater than the duration of an image frame, and the value of said bias voltage lies between −8 volts and −25 volts.

2. Display screen according to claim 1, wherein the value of said bias voltage is constant.

3. Display screen according to claim 1, wherein the control system comprises means of control of scanning of the lines of the screen that are adapted for decreasing the frequency of scanning of the lines of the screen during the screen standby mode to a frequency below the frequency of scanning of the lines during the display mode.

4. Display screen according to claim 1, wherein the control system comprises means of calculation of the sum of the said voltages applied, at each image frame, to the gate electrode of each current modulator during the screen display mode, the said means of calculation being able to determine characteristics of a bias voltage suitable for being applied to each current modulator, as a function of the said sum of the said voltages applied to this modulator, and in that the control system is able to apply, to each modulator, the said suitable bias voltage determined by the means of calculation, during the screen standby mode.

5. Display screen according to claim 4, wherein the characteristics of the bias voltage that are determined by the means of calculation comprise the duration of application of the bias voltage.

6. Display screen according to claim 4, wherein the characteristics of the bias voltage that are determined by the means of calculation comprise the value of the said bias voltage.

7. Display screen according to claim 1, wherein it comprises means for supplying power to the emitters and in that the control system comprises means for cutting the supply to the emitters during the screen standby mode.

8. Image display screen suitable for displaying image frames, comprising:

light emitters distributed as rows of emitters and columns of emitters to form an array of emitters, the emitters of the array being able to be supplied with a current during a screen display mode;

an emitter addressing circuit, associated with each emitter of the array, the said circuit comprising:

a current modulator able to supply current to said emitter, during said display mode, said modulator comprising a gate electrode and two current flow electrodes, a charge capacitance able to store, at each image frame, an addressing voltage representative of an image datum during said display mode, said voltage being applied to the gate electrode of the current modulator;

a control system able to apply a bias voltage to the gate electrode of the current modulator, during a screen standby mode, said bias voltage having a bias inverse to the bias of the addressing voltage applied to the said charge capacitance during the screen display mode, wherein the control system comprises addressing control means able to apply on the one hand said addressing voltage to the gate electrode of the current modulator during the screen display mode and, on the other hand, said bias voltage during the screen standby mode, the duration of application of said bias voltage having a bias inverse to the bias of the addressing voltage is greater than the duration of an image frame, and the display screen comprises a power generator for supplying power to the emitters and said control system comprises means arranged between each emitter and said power generator for cutting the supply to the emitters during the screen standby mode.

9. Display screen according to claim 8, wherein the control system comprises means of control of scanning of the lines of the screen that are adapted for decreasing the frequency of scanning of the lines of the screen during the screen standby mode to a frequency below the frequency of scanning of the lines during the display mode.

10. Display screen according to claim 8, wherein the control system comprises means of calculation of the sum of the said voltages applied, at each image frame, to the gate electrode of each current modulator during the screen display mode, the said means of calculation being able to determine characteristics of a bias voltage suitable for being applied to each current modulator, as a function of the said sum of the said voltages applied to this modulator, and in that the control system is able to apply, to each modulator, the said suitable bias voltage determined by the means of calculation, during the screen standby mode.

11. Display screen according to claim 10, wherein the characteristics of the bias voltage that are determined by the means of calculation comprise the duration of application of the bias voltage.

12. Display screen according to claim 10, wherein the characteristics of the bias voltage that are determined by the means of calculation comprise the value of the said bias voltage.

13. Display screen according to claim 8, wherein the means for supplying power to the emitters comprise a breaker, arranged between an emitter and said power generator, and a line for controlling the opening and the closing of the breaker.

14. Image display screen suitable for displaying image frames, comprising:

light emitters distributed as rows of emitters and columns of emitters to form an array of emitters, the emitters of the array being able to be supplied with a current during a screen display mode;

an emitter addressing circuit, associated with each emitter of the array, the said circuit comprising:

a current modulator able to supply current to said emitter, during said display mode, said modulator comprising a gate electrode and two current flow electrodes, a charge capacitance able to store, at each image frame, an addressing voltage representative of image data during said display mode, said voltage being applied to the gate electrode of the current modulator;

a control system able to apply a constant bias voltage to the gate electrode of the current modulator, during a screen standby mode, said bias voltage having a bias inverse to the bias of the addressing voltage applied to said charge capacitance during the screen display mode, wherein the control system comprises addressing control means able to apply on the one hand said addressing voltage to the gate electrode of the current modulator during the screen display mode and, on the other hand, said bias voltage during the screen standby mode, the duration of application of said bias voltage having a bias inverse to the bias of the addressing voltage is greater than the duration of an image frame, and wherein the value of said bias voltage is constant and below −8 volts.

15. Display screen according to claim 14, wherein the control system comprises means of control of scanning of the lines of the screen that are adapted for decreasing the frequency of scanning of the lines of the screen during the screen standby mode to a frequency below the frequency of scanning of the lines during the display mode.

16. Display screen according to claim 14, wherein the control system comprises means of calculation of the sum of the said voltages applied, at each image frame, to the gate electrode of each current modulator during the screen display mode, the said means of calculation being able to determine characteristics of a bias voltage suitable for being applied to each current modulator, as a function of the said sum of the said voltages applied to this modulator, and in that the control system is able to apply, to each modulator, the said suitable bias voltage determined by the means of calculation, during the screen standby mode.

17. Display screen according to claim 16, wherein the characteristics of the bias voltage that are determined by the means of calculation comprise the duration of application of the bias voltage.

18. Display screen according to claim 16, wherein the characteristics of the bias voltage that are determined by the means of calculation comprise the value of the said bias voltage.

19. Display screen according to claim 14, wherein it comprises means for supplying power to the emitters and in that the control system comprises means for cutting the supply to the emitters during the screen standby mode.

* * * * *